US005829505A

United States Patent [19]

Brescia

[11] Patent Number: 5,829,505

[45] Date of Patent: Nov. 3, 1998

[54] SAFETY GATE

[75] Inventor: Paul A. Brescia, Burlington, Mass.

[73] Assignee: Safety 1st, Incorporated, Chestnut Hill, Mass.

[21] Appl. No.: 741,373

[22] Filed: Oct. 30, 1996

[51] Int. Cl.[6] ..... E06B 3/12

[52] U.S. Cl. ..... 160/225; 49/55; 49/465

[58] Field of Search ..... 160/222, 225, 160/351; 49/55, 465, 57, 50, 463

[56] References Cited

U.S. PATENT DOCUMENTS

| | | | |
|---|---|---|---|
| 604,411 | 5/1898 | Motley . | |
| 980,535 | 1/1911 | Kleinegger . | |
| 1,013,118 | 1/1912 | Brandt . | |
| 1,120,361 | 12/1914 | Bauer . | |
| 1,352,372 | 9/1920 | Kessler . | |
| 1,662,167 | 3/1928 | Rexinger . | |
| 1,953,000 | 3/1934 | Ludwick | 156/33 |
| 2,348,561 | 5/1944 | Mutch | 160/138 |
| 2,436,344 | 2/1948 | Winogrond | 98/94 |
| 2,559,066 | 7/1951 | Diefenbronn | 20/71 |
| 2,756,469 | 7/1956 | Cattermole et al. | 20/71 |
| 2,928,146 | 3/1960 | Kuniholm | 20/71 |
| 3,000,063 | 9/1961 | Hoog | 20/71 |
| 3,163,205 | 12/1964 | Gottlieb | 160/216 |
| 3,431,966 | 3/1969 | Injeski | 160/225 |
| 3,489,201 | 1/1970 | Curry, III et al. | 160/225 |
| 3,885,616 | 5/1975 | Berkowitz | 160/215 |
| 4,088,353 | 5/1978 | Meyer | 292/36 |
| 4,492,263 | 1/1985 | Gebhard | 160/228 |
| 4,607,455 | 8/1986 | Bluem et al. | 49/55 |
| 4,846,246 | 7/1989 | Stern | 160/224 |
| 4,944,117 | 7/1990 | Gebhard et al. | 49/55 |
| 4,968,071 | 11/1990 | Stern | 292/150 |
| 5,052,461 | 10/1991 | Stern | 160/224 |
| 5,134,806 | 8/1992 | Burkart, Jr. | 49/463 |
| 5,272,840 | 12/1993 | Knoedler et al. | 49/55 X |
| 5,367,829 | 11/1994 | Crossley et al. | 49/55 X |
| 5,437,115 | 8/1995 | Freese et al. | 49/55 X |
| 5,442,881 | 8/1995 | Asbach et al. | 49/465 |
| 5,528,859 | 6/1996 | Taylor et al. | 49/55 |
| 5,535,552 | 7/1996 | Stern | 160/225 X |
| 5,570,543 | 11/1996 | Bishop | 160/225 X |

FOREIGN PATENT DOCUMENTS

| | | |
|---|---|---|
| 211486 | 11/1956 | Australia . |
| 203907 | 4/1939 | Switzerland . |

*Primary Examiner*—Kenneth J. Dorner
*Assistant Examiner*—William L. Miller
*Attorney, Agent, or Firm*—Wolf, Greenfield & Sacks, P.C.

[57] ABSTRACT

A safety gate for use in obstructing doorways, passageways and similar openings to restrict the movement of children and the like. The safety gate includes a panel that can be readily secured in and removed from the opening by extending and retracting one or more movable bumpers mounted on an outer rail of the panel. Each movable bumper is urged to the extended position in a horizontal direction by a spring that connects the bumper to a push rod which is mounted in the panel for horizontal movement in alignment with the bumper. Each push rod is connected to an actuator that is mounted in the panel for vertical movement between a lowered position and a raised position. Each movable bumper is independently urged to the extended position by its spring when its corresponding push rod is driven toward the bumper by lowering the actuator. The spring can be a compression spring having one end connected to the bumper and its opposite end connected to the push rod. Additional springs can also be provided to retract the bumpers when the actuator is raised. The panel can include a pair of gate sections that slide relative to each other to vary the effective width of the gate so as to correspond to the width of an opening that is to be obstructed by the gate. A panel locking device can be provided to secure the sections together so that the desired width does not vary. A locking handle can be carried on the top end of the actuator to easily move the actuator. A handle latching device can be provided to retain the handle and actuator in the lowered position to hold the bumpers in the extended position.

33 Claims, 9 Drawing Sheets

SAFETY GATE

BACKGROUND OF THE INVENTION

1. Field of the Invention

The present invention relates to a safety gate for use in obstructing doorways, passageways and similar openings to restrict the movement of small children and the like.

2. Description of Related Art

A variety of gates are known and presently on the market that are designed to prevent children from passing from one area to another or from ascending or descending stairways. Several of these gates can be adjusted for use in openings having various widths. Several of these gates also include moveable bumpers that can be extended from and retracted into the gate to respectively secure and release the gate from the opening.

A disadvantage of known gates that utilize moveable bumpers is that the mechanisms used to actuate the bumpers are complex and expensive. These gates conventionally incorporate mechanisms that include numerous interconnecting parts that require precise fits and positioning to interact with each other to extend and retract the bumpers. Gates are also known that utilize actuating mechanisms that include a complex arrangement of links, cranks, pull rods and springs that are interconnected to a pull handle. An example of such an actuating mechanism is disclosed in U.S. Pat. No. 5,052,461.

Another disadvantage associated with known gates is an inability of the moveable plungers to independently compensate for different spacings between each bumper and the side member of an opening. Different spacings can result from various factors such as surface irregularities of the vertical members of an opening, an opening having nonparallel vertical members and the like. Conventionally, known gates use rigid connections between the bumpers and actuating mechanism that can result in a bumper making minimal or no contact with a vertical member of the opening or a bumper exerting a very high force against the vertical member of an opening. U.S. Pat. No. 5,052,461, discussed above, is an example of a gate that incorporates a pair of spring loaded plungers to accommodate irregular door frames and control the forces exerted by the plungers. However, the actuating mechanism incorporated in this gate is a complex assemblage of parts that is expensive to manufacture.

Accordingly, it is an object of the present invention to provide an improved safety gate that overcomes these and other disadvantages associated with known gates.

SUMMARY OF THE INVENTION

In an illustrative embodiment of the invention, the safety gate comprises a panel including a vertical outer leg, at least one bumper movably mounted on the outer leg in a horizontal direction, an actuator slidably mounted for vertical movement in the panel between a raised position and a lowered position, at least one push rod connected to the actuator and mounted for horizontal movement in the panel in alignment with and independent of the bumper, and at least one spring disposed between the bumper and the push rod. The panel in use is positioned within the opening, and the bumper is moved between an extended position to secure the panel in the opening and a retracted position to release the panel from the opening. One end of the push rod is connected to the actuator and its opposite end is horizontally spaced from the bumper to establish a buffer zone therebetween. In operation, the push rod is extended toward the bumper when the actuator is lowered and is retracted away from the bumper when the actuator is raised. The spring is disposed in the buffer zone between the push rod and the bumper to urge the bumper toward the extended position when the actuator is lowered.

The gate may also include a second spring disposed between the outer leg of the panel and the first spring to urge the bumper toward the retracted position when the actuator is raised. The springs can be compression springs that have spring constants that are different from each other. While an illustrative embodiment of the gate is shown with a pair of movable bumpers, push rods and springs, the gate may include fewer or greater numbers of bumpers, push rods and springs. If multiple movable bumpers are used, the springs may independently urge the bumpers toward their respective extended or retracted positions.

The panel may include one or more stops to limit the horizontal movement of the bumper, push rod, or both. The panel may be made up of a pair of gate sections that are slidably connected together to allow the gate width to be adjusted to accommodate openings, such as passageways of various widths. A locking device may be provided to secure the gate sections in a desired width.

The gate may also include a handle carried on top of the actuator to lower and raise the actuator to respectively extend and retract the bumper or bumpers. A handle latching device may be provided for releasably retaining the handle and actuator to hold the bumpers in the extended position.

As another aspect of the invention, the safety gate comprises a panel that includes a vertical outer leg, at least one bumper mounted on the outer leg and movable in a horizontal direction, an actuator slidably mounted for vertical movement in the panel, at least one push rod coupled to the actuator and mounted for horizontal movement in the panel in alignment with the bumper, and at least one pair of springs, one of the springs coupling the push rod to the bumper and the second spring disposed between the first spring and the outer leg. The panel in use may be positioned within the opening, and the bumper may be moved between an extended position to secure the panel within the opening and a retracted position to release the panel from the opening. To operate the gate, the push rod may be extended toward the bumper by lowering the actuator which causes the first spring to urge the bumper toward the extended position. Conversely, the push rod may be retracted away from the bumper by raising the actuator which causes the second spring to urge the bumper toward the retracted position.

As a further aspect of the invention, the safety gate comprises a pair of generally flat gate sections, a locking device joining the gate sections together, a pair of horizontally extending fixed bumpers mounted on the outer frame member of the first gate section and positioned to engage one side of a passageway in which the gate is to be mounted, a pair of horizontally extending movable bumpers mounted on the outer frame member of the second gate section and positioned to engage the other side of the passageway, and a pair of push rods that are slidably mounted for horizontal movement in the second gate. The push rods are in alignment with and connected to the pair of movable bumpers for extending and retracting them. The gate also includes an actuator that is slidably mounted for vertical movement in the second gate section. The actuator is connected to each push rod so as to drive the movable bumpers toward the extended position to secure the gate when the actuator is in a lowered position and to retract the movable bumpers to release the gate when the actuator is in a raised position. The gate sections are slidably connected together in face-to-face relationship and have an effective combined width that may be varied to obstruct passageways of different widths. The locking device enables the sections to be secured in a fixed relationship to one another so that their combined effective width will not vary.

BRIEF DESCRIPTION OF THE DRAWINGS

It should be understood that the drawings are provided for the purpose of illustration only and are not intended to define the limits of the invention. The foregoing and other objects and advantages of the present invention will become apparent with reference to the following detailed description when taken in conjunction with the accompanying drawings in which.

DETAILED DESCRIPTION

Figure 1:
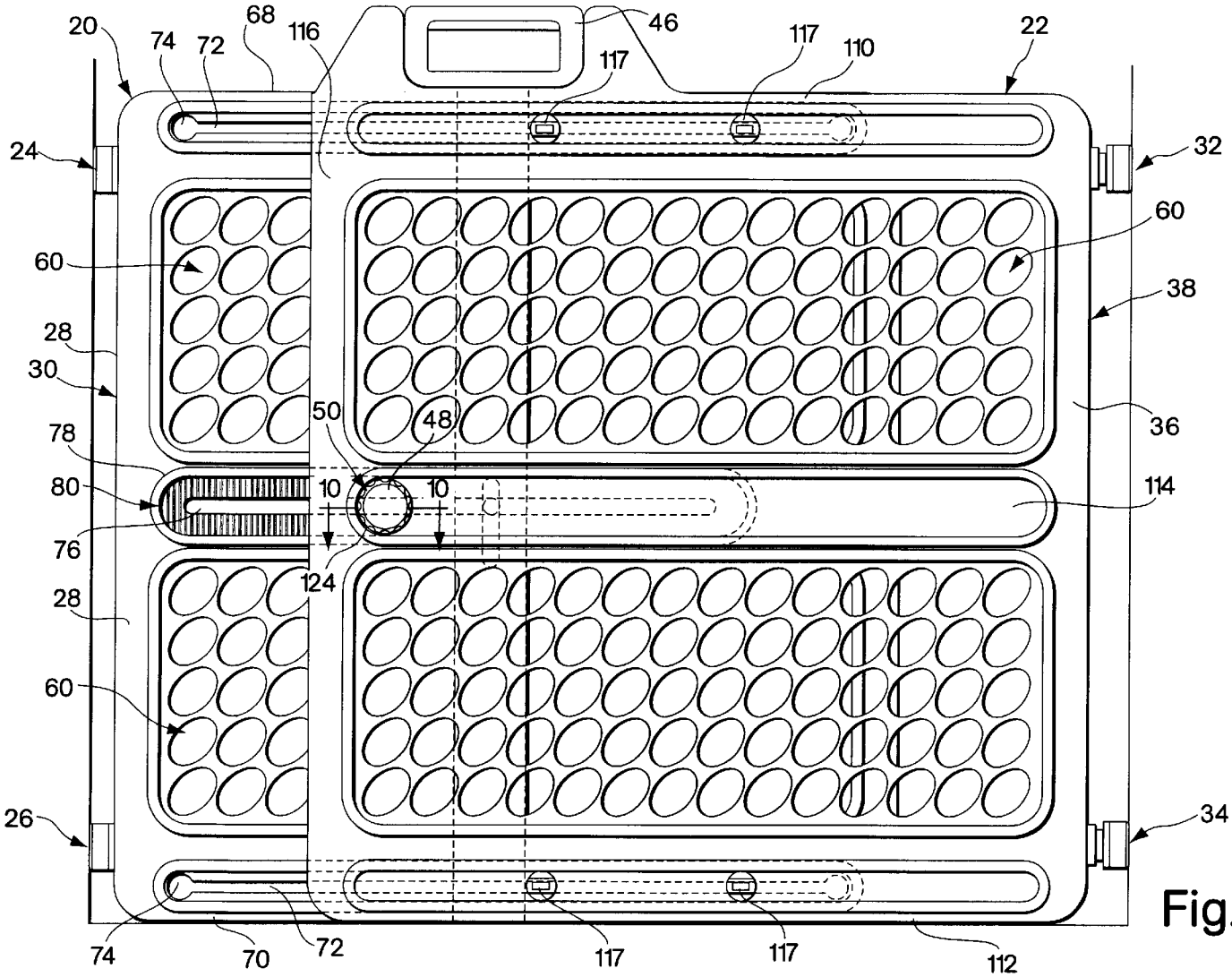
FIG. 1 is a front elevational view of a safety gate of the present invention mounted in a doorway.

The child safety gate shown in FIGS. 1–6 is comprised of two major gate sections, including a rear gate section 20 and a front gate section 22, disposed in face-to-face relationship with one another and slidably connected together so that the effective total width of the gate may be adjusted to accommodate the various widths of passageways to be obstructed by the gate. The rear gate section 20 carries a pair of stationery bumpers 24 and 26 on the vertical outer leg 28 of its frame 30. A pair of extendable bumpers 32 and 34 are carried on the vertical outer leg 36 of the frame 38 of the front gate section 22. The extendable bumpers 32 and 34 are each mounted on the end of a push rod 40 (FIGS. 7 and 8) that is in turn mounted for translational motion on the front gate section 22. The push rods 40 are connected by links 42 to a vertically movable actuator 44 that carries a handle 46 at its upper end and which is also mounted on the front gate section 22. It is to be appreciated that a greater or lesser number of stationary bumpers 24 and 26 and extendable bumpers 32 and 34 than that shown in the illustrative embodiment may be utilized to secure the gate in a passageway.

Gross adjustments of the effective width of the gate are made by moving the gate sections 20 and 22 with respect to one another so as to position the fixed bumpers 24 and 26 and the movable bumpers 32 and 34 essentially in contact with the sides of the passageway in which the gate is to be installed. The extendable bumpers 32 and 34 should be in their retracted position during gross adjustment of the gate width. The gross adjustment is made by loosening the knob 48 of the width adjustment locking assembly 50 and moving the gate sections 20 and 22 in their respective planes so as to place the bumpers carried by each gate section against the side of the passageway. When that is accomplished, the knob 48 is tightened to hold the gate sections in fixed position with respect to one another. Thereafter, the actuator 44 is depressed by means of the handle 46 so as to move the push rods 40 in the horizontal direction toward the outer leg 36 of the frame 38 of the front gate section 22 and to drive the bumpers 32 and 34 firmly against the side of the passageway. That action causes the bumpers to be compressed against the sides of the passageway so as to firmly hold the gate assembly in position. To remove the gate, the handle 46 on the actuator 44 is released which enables the handle and actuator to be raised, and that in turn retracts the push rods 40 so as to reduce the pressure on the bumpers. The various elements of the gate are described in greater detail below.

The rear gate section 20 includes the rear frame 30, which defines the outer extremities of the rear gate section 20, and grating 60 which is separated into upper and lower sections by a frame crossbar 62 that extends horizontally between the vertical outer leg 28 and the vertical inner leg 64. The grating 60 is made up of an array of elliptical apertures 66 that allow the free flow of air through the gate but are small enough so as to preclude even a small child from putting a hand or foot through the mesh.

Figure 2:
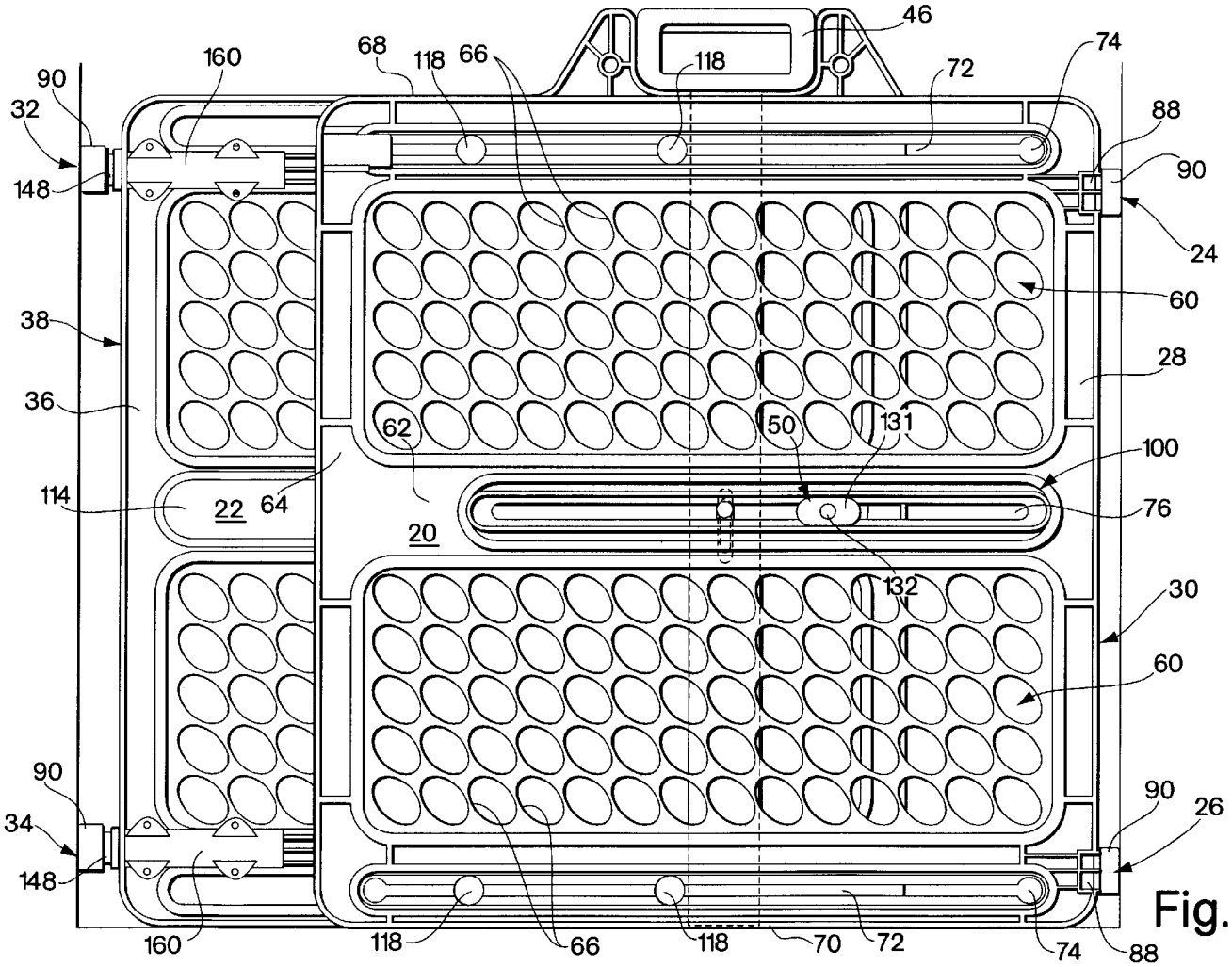
FIG. 2 is a rear view of the safety gate of FIG. 1.
Figure 3:
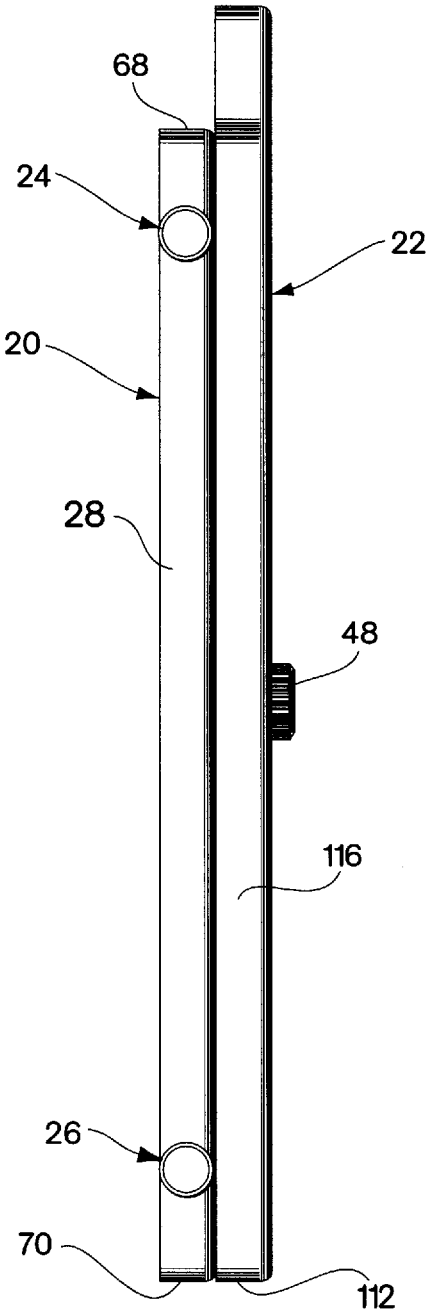
FIG. 3 is a left side elevational view of the safety gate of FIG. 1.
Figure 4:
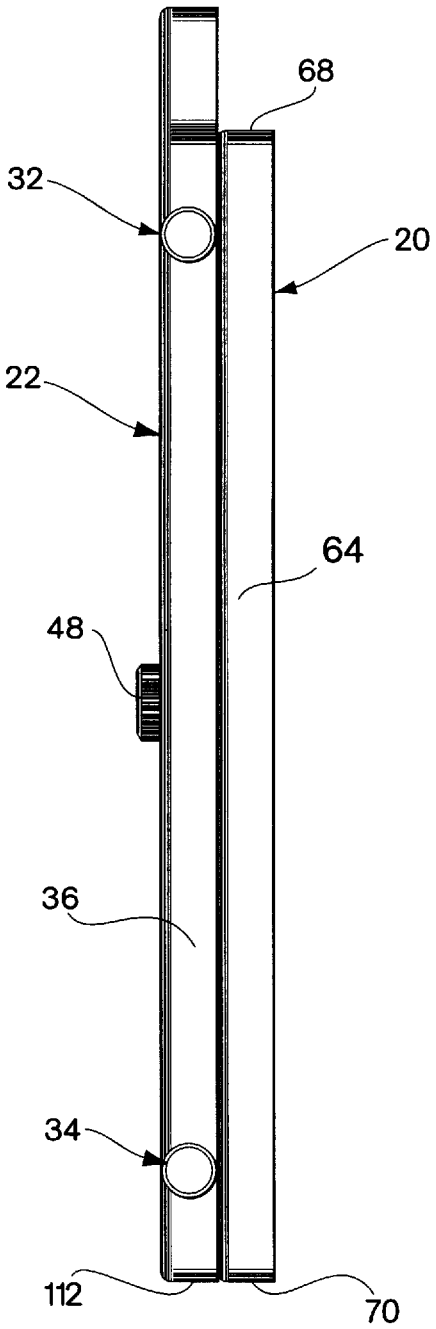
FIG. 4 is a right side elevational view of the safety gate of FIG. 1.
Figure 5:
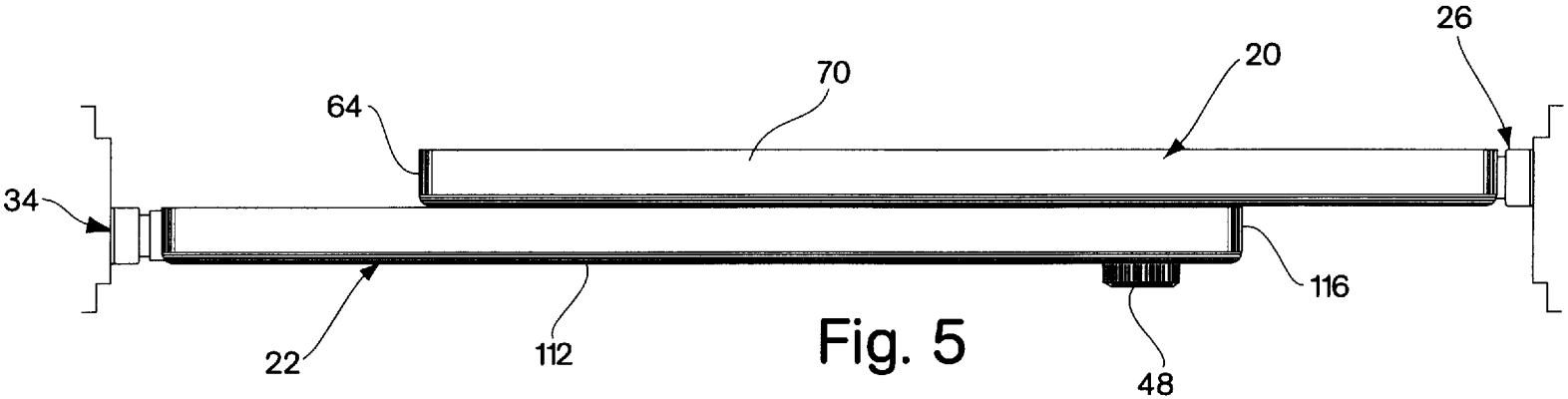
FIG. 5 is a bottom view of the safety gate of FIG. 1.
Figure 6:
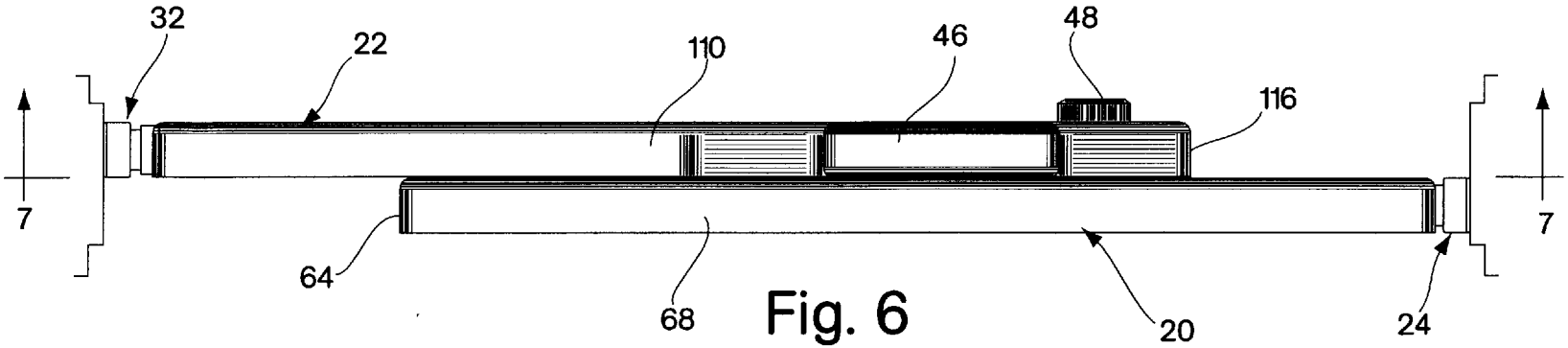
FIG. 6 is a top view of the safety gate of FIG. 1.

The upper and lower horizontal legs 68 and 70 of the frame 30 each are provided with an elongated slot 72 that extends substantially from the outer leg 28 to the inner leg 64 of the frame. As shown in FIG. 2, each slot 72 is provided with an enlarged opening 74 at its end adjacent the stationary bumpers 24 and 26 so as to enable the head of lock posts 117, as described below, carried by the front gate section 22 to be inserted through the opening 74 and into the slots 72 to thereby hold the gate sections 20 and 22 together.

Figure 9:
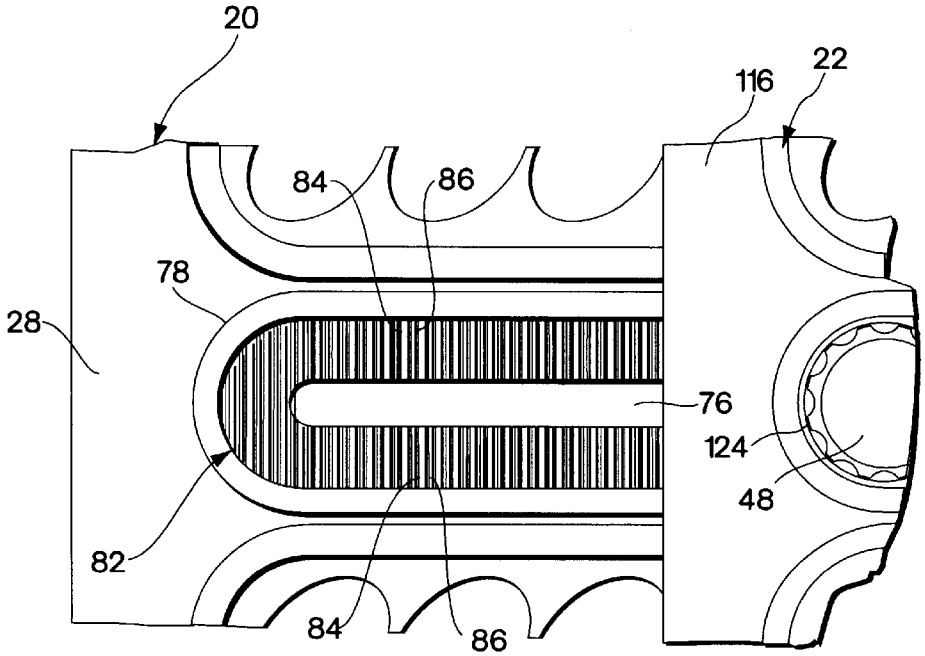
FIG. 9 is an enlarged front view of the elongated front well and rack for the width adjustment locking assembly.

As shown in FIGS. 1 and 9, the crossbar 62 also has an elongated slot 76 that extends across substantially the length of the crossbar 62 and is disposed in a shallow elongated front well 78. The base wall 80 of the front well 78, through which the slot 76 is formed, is shaped with a rack 82 that spans the slot 76. The rack 82 is comprised of closely spaced teeth 84, each having a steep face 86 to assist in locking the rear gate section 20 to the front gate section 22.

Each of the stationary bumpers 24 and 26 has a base 88 and a cap 90. Each base 88 is integrally molded on the rear gate section 20 and the caps 90 are separately molded of a pliable plastic material, such as polyvinyl chloride (PVC), that will not mar the surface of the passageway sides when engaged by the bumpers. The caps 90 are snapped onto the bases 88 and once attached are not intended to be removed.

Referring to FIG. 2, a rear well 100, somewhat smaller than the front well 78, is disposed on the back of the rear gate section 20 opposite the front well 78, and is defined by an endless flange 102 and the base wall 80. The slot 76 which extends through the bottom wall 80 is, of course, exposed on both sides of the gate section 20. Unlike in the front well 78, the rear surface of the base wall 80 is smooth and does not carry a rack or any other irregular surface to allow a nut-like fastener 131 to slide along the rear well 100.

The front gate section 22 is approximately the same size as the rear gate section 20, and its frame 38 includes upper and lower horizontal legs 110 and 112, a crossbar 114 and a vertical inner leg 116, along with the vertical outer leg 36.

To stabilize the connection between the rear and front gate sections 20 and 22, lock posts 117 are integrally formed on the rear surface of each of the upper and lower horizontal legs 110 and 112 of the frame 38 of the front gate section 22. The lock posts 117 are sized so they extend into and through the slots 72 on the rear gate section 20 and enter the slots 72 through the enlarged openings 74 so as to hold the two sections in sliding relationship with one another. Each lock post includes a head 118 that has a diameter that is greater than the width of the slots 72 to maintain the posts in the slots as the gate sections are adjusted in their respective planes to a desired width. The narrowest effective width of the gate assembly is achieved when the gate sections overlie one another so that their vertical inner and outer legs are aligned. The effective width of the gate may be increased by moving the gate sections with respect to one another so that the outer legs of each section move apart.

Figure 7:
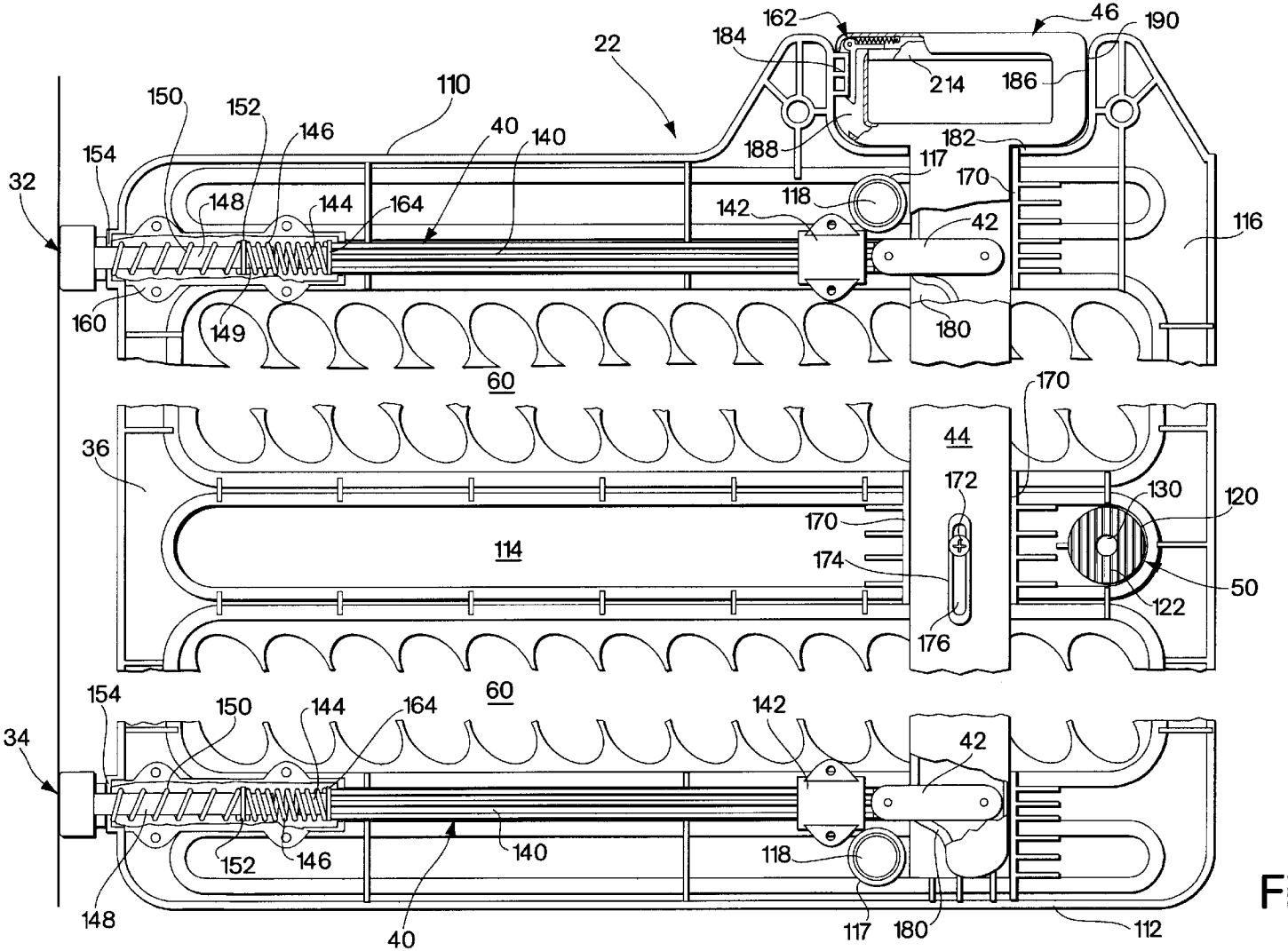
FIG. 7 is a partial, fragmentary cross-sectional rear elevational view of the gate locking mechanism of the safety gate of FIGS. 1–6 taken along section line 7—7 in FIG. 6 shown with the gate locking mechanism in the locked position.
Figure 8:
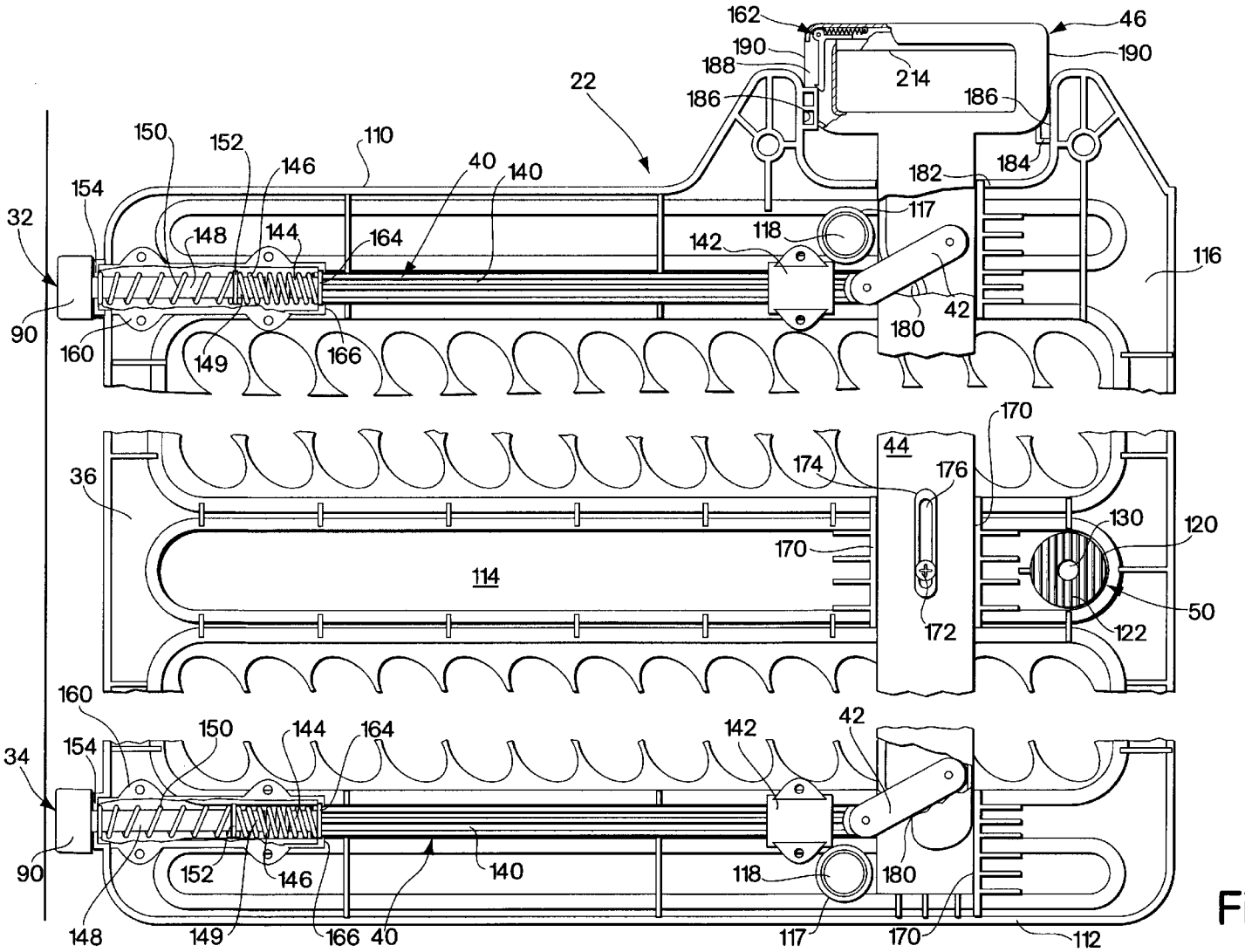
FIG. 8 is a partial, fragmentary cross-sectional rear elevational view similar to FIG. 7 shown with the gate locking mechanism in the unlocked position.
Figure 10:
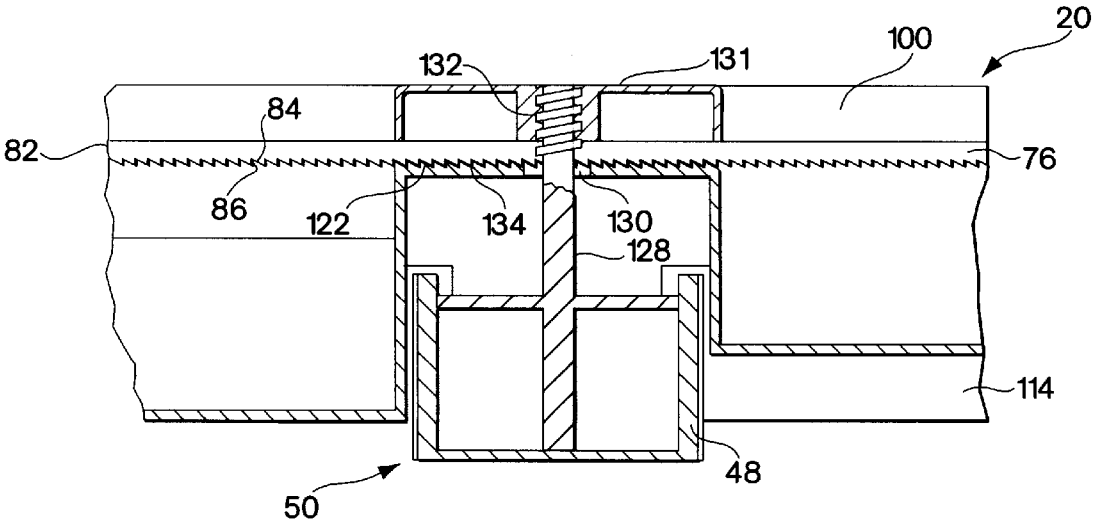
FIG. 10 is an enlarged cross-sectional top view of the width adjustment locking assembly of the safety gate taken along section line 10—10 in FIG. 1.

As shown in FIGS. 7, 8 and 10, the crossbar 114 carries a boss 120 adjacent the vertical inner leg 116 of the frame whose diameter is slightly smaller than the width of the front well 78 of the rear gate section 20. The rearward most surface of the boss 120 is serrated with teeth 122 which are designed to register with the teeth 84 of the rack 82 in the front well 78. Thus, when the gate sections are slid horizontally with respect to one another, the boss 120 moves along the front well 78 and the respective teeth 122, 84 on the boss 120 and rack 82 slide over one another. The front face of the front gate section 22 has a counterbore-type recess 124 aligned with the boss 120 that receives the knob 48 that forms part of the width adjustment locking assembly 50. The knob 48 carries a threaded stem 128 that extends through the opening 130 in the boss 120. When the gate is assembled, the stem 128 extends through the slot 76 in gate section 20 and engages the nut-like member 131 disposed in the rear well 100 of the crossbar 62 in the rear gate section 20. The elongated shape of the nut-like member 131 prevents it from rotating and, therefore, the stem 128 may be threaded into and out of the threaded hole 132 of the nut 131 so as to loosen and tighten the gate sections to one another. It will be appreciated that the teeth 122 carried on the boss 120 have generally vertical faces 134 which engage the generally vertical faces of the teeth 84 on the rack 82 so that the gate sections are held very firmly together and cannot slide relative to each other so as to shorten the effective width of the gate assembly when the knob 48 is tightened. However, the formation of the teeth both on the boss 120 and the rack 82 allows the gate sections to move rather freely so as to increase their effective width when the knob 48 is loosened.

In FIGS. 7, 8 and 11–13, the locking mechanism including the movable bumpers 32 and 34 along with the push rods 40, the actuator 44 as well as the handle 46 and the handle latching device 162 incorporated into the front frame 38 are shown in detail. As the push rod assemblies are identical, only one is described. Referring first to FIGS. 7 and 8, it will be noted that the push rod 40 includes a main translating link 140 which is captured within a guide 142 secured to one of the horizontal legs of the frame 38. The translating link 140 carries a link connector 144 at its end opposite the actuator 44 that engages one end of a first compression spring 146. The movable bumper 32 (34) is carried by a bumper stem 148 that includes a stem connector 149 and stem flange 152 which engages the other side of the first compression spring 146. A second compression spring 150 surrounds the bumper stem 148 and bears at one end against the stem flange 152 opposite the first compression spring 146 and at its other end against a flange 154 formed on the rear surface of the outer vertical leg 36 of the frame 38. The second spring 150 serves to urge the stem 148 toward the retracted position so as to retract the bumper 32 (34) while the first spring 146 serves as an override to allow the translating link 140 to push the bumper 32 (34) into the extended position against the side of the passageway closed by the gate. The lengths of the translating link 140 and the bumper stem 148 are sized to maintain a buffer zone between the link connector 144 and the stem connector 149 so that they do not contact each other even when the bumper stem 148 is fully retracted into the housing 160 and the translating link 140 is fully extended into the housing 160. The buffer zone allows the first spring 146 to act as a cushion so as to absorb any override of the translating link 140 as it pushes outwardly against the bumper stem 148 to extend the bumper. A significant advantage to coupling the translating link 140 to the bumper stem 148 with the first compression spring 146 and a buffer zone therebetween lies in the ability of the moveable bumpers 32 and 34 to individually accommodate different spacings between the outer rail 36 of the front gate section 22 and the side of a passageway without subjecting the components of the locking mechanism to undue stresses. Similar to the stationary bumpers 24 and 26, each extendable bumper 32 and 34 includes a bumper cap 90 snapped onto the bumper stem 148.

The first and second springs 146 and 150 should be sized to ensure that sufficient forces are produced to properly secure the gate in a passageway when the actuator 44 is lowered and to fully retract the extendable bumpers when the actuator 44 is raised. In the illustrative embodiment shown, each extendable bumper 32 and 34 preferably exerts from approximately 58 lbs to approximately 86 lbs against the side of the passageway when the actuator 44 is lowered to extend the bumpers. This force can be produced using a first compression spring 146 having a spring constant of approximately 115 lbs/in (pounds per inch) which is compressed from approximately 0.5 inches to approximately 0.75 inches between the translating link 140 and the bumper stem 148 when the actuator 44 is lowered. Because the first compression spring 146 does not include a preload when the actuator 44 is raised to release the gate, the second compression spring 150 needs only to produce enough force to overcome frictional forces exerted on the bumpers 32 and 34 to retract them. Sufficient force can be produced using a second spring 150 having a spring constant of approximately 4.1 lbs/in and which is slightly preloaded when the actuator 44 is raised. The difference in spring constants also ensures that the retaining force produced by the first spring 146 is not significantly offset by the opposing force of the second spring 150.

Each of the springs 146 and 150 may be made from music wire suitable for providing the desired spring characteristics. For example, the first spring 146 may have a wire diameter of 0.125 inches, an outer diameter of 0.97 inches and a free length of 1.75 inches. The second spring 150 may have a wire diameter of 0.062 inches, an outer diameter of 0.97 inches and a free length of 4.0 inches. It should be appreciated that the particular spring constants and sizes are exemplary only and other materials, sizes and spring characteristics may be used in accordance with the present invention.

Figure 11:
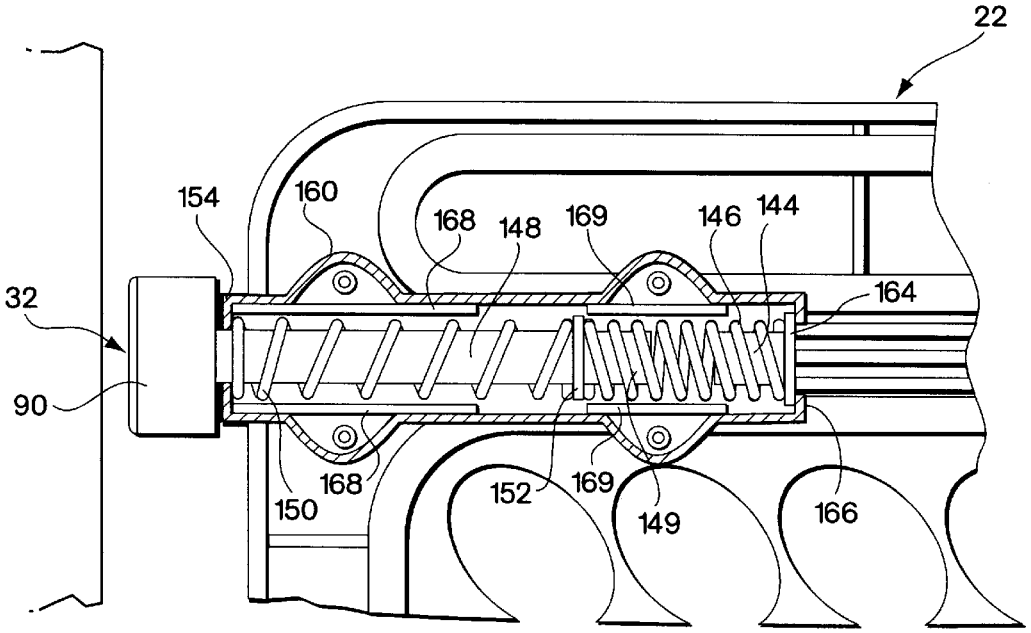
FIG. 11 is an enlarged fragmentary rear view of an extendable bumper of the safety gate of FIGS. 1–6 illustrating the bumpers in a fully retracted position.

A housing 160 is secured to each horizontal leg 110 and 112 of the front frame 38 adjacent the outer leg 36 to capture and retain the bumper biasing components, as described above, to the frame. As shown in FIGS. 7, 8 and 11, the outer edge of the bumper stem flange 152 engages the inner wall of the housing 160 and the flange 154 on the outer leg 36 of the frame engages the outer surface of the stem 148 to hold the stem in a horizontal position as it is retraced and extended. Similarly, the translating link connector 144 includes a connector flange 164 which also engages the inner wall of the housing 160 and a rear flange 166 of the housing 160 to limit the movement of the translating link 140 to the horizontal direction and to ensure that the connector 144 remains captured in the housing 160. To limit the horizontal travel of the stem 148 and the translating link 140, two groups of elongated horizontal stops extend inwardly from the inner wall of the housing 160. A first group of stops 168 is disposed between the outer leg flange 154 and the stem flange 152 so as to engage the stem flange 152 and limit the extension of the stem 148 and moveable bumper 32 (34) from the housing. A second group of stops 169 is disposed between the stem flange 152 and the connector flange 164 so as to engage the stem flange 152 and limit the retraction of the stem 148 into the housing and to also limit the extension of the translating link connector 144 into the housing 160. The limitations on the travel of the stem 148 and translating link 140 ensure that the buffer zone between them is maintained and the first and second springs 146 and 150 generate sufficient biasing forces without being over stressed. It should be appreciated that the actual number and shape of the stops can be varied.

Referring to FIGS. 7 and 8, the actuator 44, which is an elongated and generally rectangular member, is disposed in a vertical channel defined by vertically extending sidewalls 170 integrally formed in the front frame 38. The actuator 44 is retained to the front frame 38 by a fastener 172, such as a shoulder screw, which is disposed in an elongated recess 174 having an elongated slot 176 therethrough. A boss (not shown) extends away from the rear surface of the front gate section 22 and through the slot 176 to guide the actuator 44 and to ensure that the shoulder screw cannot be tightened against the base of the recess 174 so that the actuator 44 can easily slide within the vertical channel. Each translating link 140 is coupled to the actuator by a link 42 pivotally connected to both of them. The actuator 44 has a pair of curved recesses 180 that receive the links 42 when the actuator is raised to the unlocked position. The recesses 180 allow the links 42 and the actuator 44 to move within a compact arrangement to fully extend and retract the bumpers. The links 42 transform the vertical movement of the actuator 44 into horizontal movement of the translating links 140 so as to extend and retract the bumpers 32 and 34 as the actuator 44 is respectively moved downward and upward.

The handle 46 is supported at the top end of the actuator 44 as a means to drive the actuator in the vertical direction. The upper horizontal leg 110 of the front frame 38 includes a generally U-shaped seat 182 which is contoured to receive the handle 46 in the lowered or locked position. The seat 182 includes vertical guides 184 disposed on opposing inner sidewalls 186 that are received in corresponding slots 188 on the outer sidewalls 190 of the handle 46 to guide the movement of the handle in the vertical direction.

Figure 12:
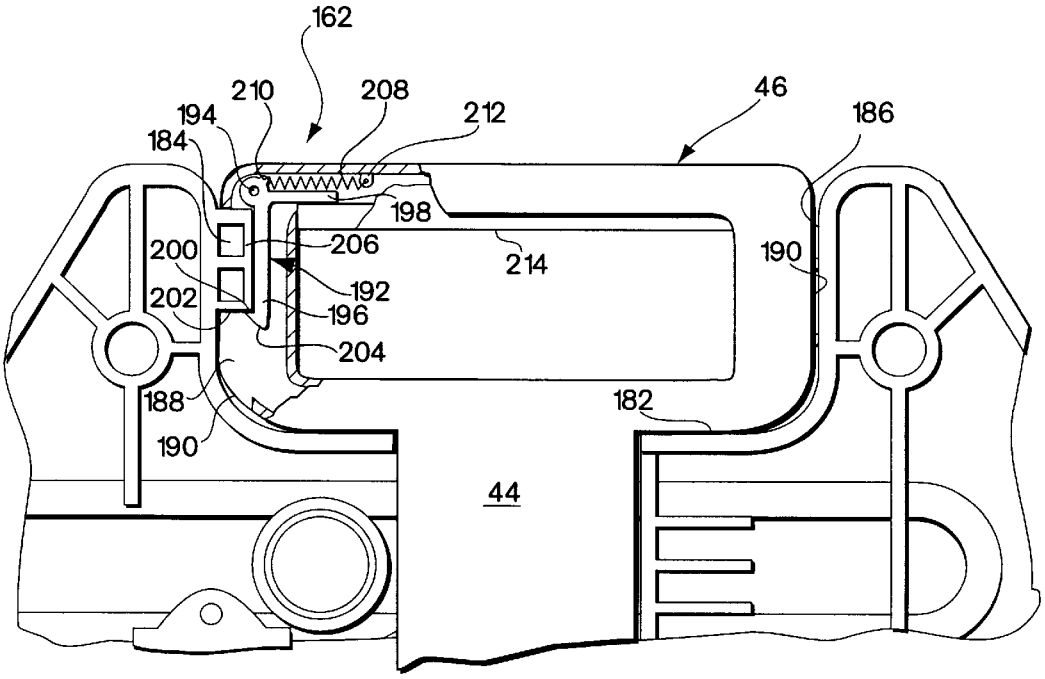
FIG. 12 is an enlarged fragmentary rear view of the handle latching device of the safety gate of FIGS. 1–6 illustrating the handle in a locked position.
Figure 13:
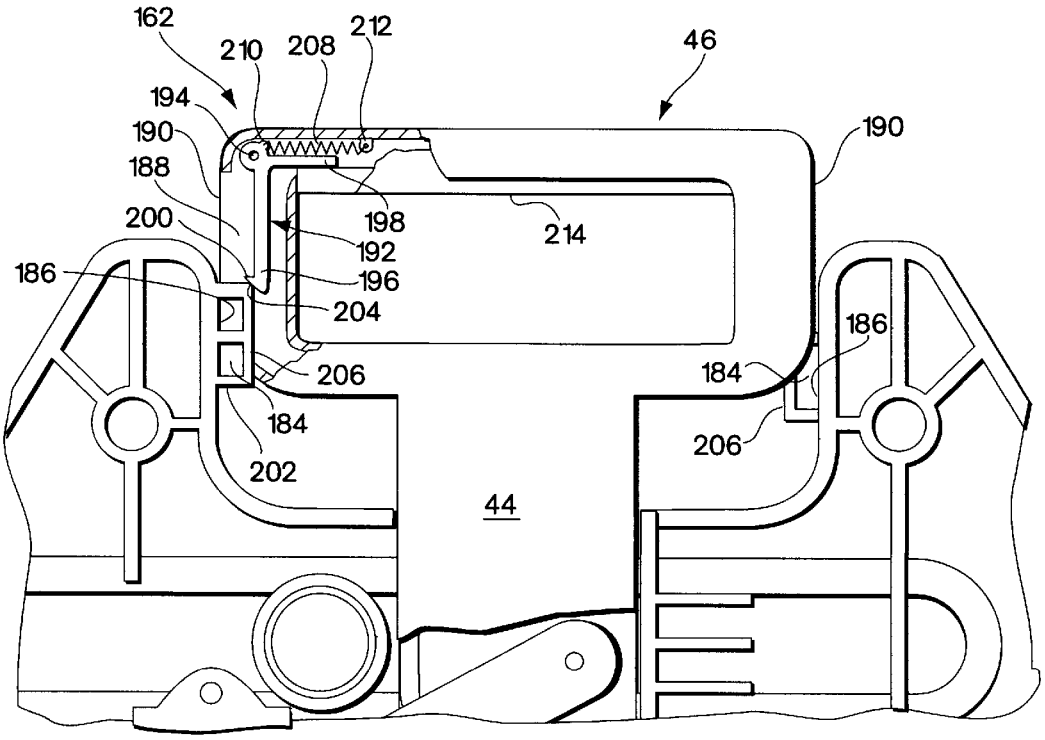
FIG. 13 is an enlarged fragmentary rear view of the handle latching device of the safety gate of FIGS. 1–6 illustrating the handle in an unlocked position.

As shown in FIGS. 12 and 13, a handle latching device 162 (only one is shown) is provided in each side of the handle 46 adjacent the vertical slot 188 as a means to lock the handle in the closed position to ensure that the moveable bumpers 32 and 34 cannot be inadvertently retracted to release the gate from the passageway. Because the handle latching devices 162 are identical, only one is described. It is to be appreciated that a single handle latching device 162 in one side of the handle 46 may be utilized to lock the handle.

Each handle latching device 162 includes an L-shaped latch 192 rotatably mounted on a pivot 194 in an upper corner of the handle 46. The latch 192 includes a vertical locking arm 196 extending downwardly from the pivot 194 and a horizontal lever 198 extending into the handle away from the pivot 194. A locking barb 200 disposed on the free end of the locking arm 196 opposite the pivot 194 engages the lower lip 202 of the guide 184 to lock the actuator 44 when the handle 46 is pushed down into the seat 182. The barb 200 has a cam surface 204 which engages the outer surface 206 of the guide 184 to rotate the latch 192 as the handle 46 moves downward. The locking arm 196 is biased to the vertical locking position by a spring 208 that is connected between an ear 210 of the latch 192 extending above the pivot 194 and a fixed post 212 on the handle 46. To unlock the latch, a trigger 214, which is shown as an elongated bar mounted in the handle 46, is squeezed to engage and rotate the lever 198 about the pivot 194. Rotation of the lever 198 similarly causes the locking arm 196 to rotate so that the barb 200 disengages the guide 184, and the handle 46 can be pulled in an upward direction. When the trigger 214 is released, the force of the spring 208 causes the latch 192 to rotate in the opposite direction to place the locking arm 196 in the vertical locking position.

The handle latching device 162 itself can be locked to prevent a child from unlocking the actuator 44 and disengaging the movable bumpers 32 and 34 from the passageway. To lock the handle latching device, the handle 46 is pulled upwardly away from the seat 182 without squeezing the trigger 214 so that the locking barb 200 is firmly seated against the lower lip 202 of the guide 184. The interaction between the locking barb and the lower lip maintains the latch in a locked position thereby preventing the trigger 214 from being depressed to pivot the latch. This locking capability can be enhanced with a recess or a detent (not shown) on the lower lip 202 of the guide 184 that respectively receives or mates with the locking barb. To unlock the trigger 214 and the handle latching device 162, the handle 46 is pushed downwardly into the seat 182 to disengage the locking barb 200 from the lower lip 202 prior to squeezing the trigger so that the latch 162 can pivot when the trigger is depressed.

The various components of the safety gate preferably are molded of a suitable plastic material, such as a polypropylene copolymer or acrylonitrile-butadiene-styrene (ABS). Generally, the components associated with the locking functions of the gate, such as the actuator 44, links 42, translating links 144, handle latch 192 and width adjustment locking assembly 50, are preferably molded of ABS so these parts have sufficient rigidity. Other components, such as gate frames 30 and 38, guides 142, bumper stems 138 and housings 160, are preferably molded of a polypropylene copolymer. It should be appreciated that other processes and materials may be used to make a safety gate in accordance with the present invention.

Having described a particular embodiment of the invention in detail, various modifications and improvements will readily occur to those skilled in the art. Such modifications and improvements are intended to be part of this disclosure and within the spirit and scope of the invention. Accordingly, the foregoing description is by way of example only and the invention is defined by the following claims and their equivalents.

What is claimed is:

1. A safety gate for obstructing an opening, the gate comprising:

a panel constructed and arranged to be positioned within the opening and including a vertical outer leg that is to be positioned adjacent a vertical member of the opening;

at least one bumper mounted on the outer leg and movable in a horizontal direction between an extended position to secure the panel in the opening and a retracted position to release the panel from the opening;

an actuator slidably mounted for vertical movement in the panel between a raised position and a lowered position;

at least one push rod connected to the actuator and mounted for horizontal movement in the panel, the horizontal movement being in alignment with and independent of the bumper, the push rod having a first end connected to the actuator and a second end terminating in a lip that is disposed in spaced relation from the bumper to establish a buffer zone therebetween, the push rod being extended toward the bumper when the actuator is lowered and being retracted away from the bumper when the actuator is raised; and at least one first spring disposed in the buffer zone between the second end of the push rod and the bumper to transfer movement of the push rod to the bumper to drive the bumper toward the extended position when the actuator is moved toward the lowered position.

2. The safety gate recited in claim 1, wherein the bumper includes a bumper connector to engage one end of the first spring and the push rod includes a push rod connector at the second end to engage the other end of the first spring.

3. The safety gate recited in claim 2, further comprising at least one second spring disposed between the outer leg and the bumper connector to urge the bumper toward the retracted position when the actuator is moved to the raised position.

4. The safety gate recited in claim 3, wherein the bumper connector includes a flange disposed between the first spring and the second spring.

5. The safety gate recited in claim 4, wherein the panel includes at least one first stop disposed between the outer leg and the bumper connector to limit the extension of the bumper from the outer leg.

6. The safety gate recited in claim 5, wherein the panel includes at least one second stop disposed in the buffer zone between the bumper connector and the push rod connector to limit the retraction of the bumper into the outer leg and to limit the extension of the push rod toward the bumper.

7. The safety gate recited in claim 3, wherein the first spring and the second spring are compression springs.

8. The safety gate recited in claim 7, wherein the first spring has a first spring constant and the second spring has a second spring constant that is less than the first spring constant.

9. The safety gate recited in claim 8, wherein the at least one bumper includes a pair of bumpers, the at least one push rod includes a pair of push rods, the at least one first spring includes a pair of first springs and the at least one second spring includes a pair of second springs, the pair of first springs independently transferring movement of the pair of push rods to the pair of bumpers to drive the pair of bumpers toward the extended position when the actuator is moved toward the lowered position, the pair of second springs independently urging the pair of bumpers toward the retracted position when the actuator is moved toward the raised position.

10. The safety gate recited in claim 1, wherein the at least one bumper includes a pair of bumpers, the at least one push rod includes a pair of push rods and the at least one first spring includes a pair of first springs, the pair of first springs independently transferring movement of the pair of push rods to the pair of bumpers to drive the pair of bumpers toward the extended position when the actuator is moved toward the lowered position.

11. The safety gate recited in claim 10, further comprising a handle carried on a top end of the actuator that is constructed and arranged to be moved to drive the actuator in the vertical direction.

12. The safety gate recited in claim 11, further comprising a handle latching device mounted on the handle and the panel for releasably retaining the handle and the actuator in the lowered position to hold the pair of bumpers in the extended position.

13. The safety gate recited in claim 12, wherein the panel includes a pair of gate sections slidably connected together and having an effective combined width that may be varied to obstruct openings of different widths.

14. The safety gate recited in claim 13, further comprising a width adjustment locking device constructed and arranged to secure the pair of gate sections together to maintain a desired width.

15. A safety gate for obstructing an opening having a vertical member, the gate comprising:

a panel constructed and arranged to be positioned within the opening, the panel including a vertical outer leg that is to be positioned adjacent the vertical member of the opening;

at least one bumper mounted on the outer leg and movable in a horizontal direction between an extended position to secure the panel within the opening and a retracted position to release the panel from the opening;

an actuator slidably mounted for vertical movement in the panel between a raised position and a lowered position;

at least one push rod coupled to the actuator and mounted for horizontal movement in the panel in alignment with the bumper, the push rod being extended toward the bumper when the actuator is lowered and being retracted away from the bumper when the actuator is raised; and at least one pair of springs including a first spring coupling the push rod to the bumper and a second spring disposed between the first spring and the outer leg, the first spring urging the bumper toward the extended position when the actuator is moved toward the lowered position and the second spring urging the bumper toward the retracted position when the actuator is moved toward the raised position.

16. The gate recited in claim 15, wherein the first spring has a first spring constant and the second spring has a second spring constant that is less than the first spring constant.

17. The gate recited in claim 16, wherein the first spring and the second spring each is a compression spring.

18. The safety gate recited in claim 17, wherein the at least one bumper includes a pair of bumpers, the at least one push rod includes a pair of push rods, and the at least one pair of springs includes a first pair of springs and a second pair of springs, the first spring of each of the first and second pairs of springs independently urging each of the pair of bumpers toward the extended position when the actuator is lowered.

19. The gate recited in claim 15, further comprising at least one link connecting the push rod to the actuator, one end of the link being pivotally connected to the push rod and the other end of the link being pivotally connected to the actuator.

20. The safety gate recited in claim 19, further comprising a handle disposed on a top end of the actuator to drive the actuator in the vertical direction.

21. The safety gate recited in claim 20, further comprising a handle latching device mounted on the handle and the panel for releasably retaining the handle and the actuator in the lowered position to hold the bumper in the extended position.

22. The safety gate recited in claim 21, wherein the panel includes a pair of gate sections slidably connected together and having an effective combined width that may be varied to obstruct openings of different widths and a width adjustment locking device constructed and arranged to secure the pair of gate sections together to maintain a desired width.

23. The gate recited in claim 15, wherein the bumper includes a bumper stem extending toward the push rod and a stem flange disposed on the bumper stem adjacent the push rod, the second spring being disposed about the bumper stem between and in engagement with the outer leg and one side of the stem flange.

24. The gate recited in claim 23, wherein the push rod includes a rod flange disposed opposite the stem flange, the first spring being disposed between and in engagement with the rod flange and the other side of the stem flange opposite the second spring.

25. A safety gate comprising:

a pair of generally flat gate sections, including a first gate section and a second gate section, disposed in face-to-face relationship and slidably connected together, the pair of gate sections having an effective combined width that may be varied to obstruct passageways of different widths, each of the gate sections having outer, inner, upper and lower frame members;

a locking device joining the first and second gate sections enabling them to be secured in a fixed relationship to one another so that the combined effective width will not vary;

a pair of horizontally extending fixed bumpers mounted on the outer frame member of the first gate section and positioned to engage one side of a passageway in which the gate is to be mounted;

a pair of horizontally extending movable bumpers mounted on the outer frame member of the second gate section and positioned to engage the other side of the passageway in which the gate is to be mounted, the pair of movable bumpers being movable between an extended position to secure the gate in the passageway and a retracted position to release the gate from the passageway;

a pair of push rods slidably mounted for horizontal movement in the second gate section in alignment with the pair of movable bumpers for extending and retracting the movable bumpers;

an actuator slidably mounted for vertical movement in the second gate section, the actuator being connected to each push rod to drive the movable bumpers toward the extended position when the actuator is in a lowered position, the movable bumpers being retracted when the actuator is in a raised position, a first pair of springs, one each transferring movement of one of the pair of push rods to a respective one of the pair of movable bumpers, the first pair of springs being compression springs that are driven by the push rods to urge the movable bumpers toward the extended position when the actuator is lowered; and a second pair of compression springs disposed in alignment with the first pair of compression springs to urge the movable bumpers toward the retracted position when the actuator is raised.

26. The safety gate recited in claim 25, further comprising a pair of links interconnecting the pair of push rods to the actuator.

27. The safety gate recited in claim 26, wherein each link is pivotally connected to the actuator and one of the push rods.

28. The safety gate recited in claim 27, further comprising a handle carried by and movable with the actuator and disposed in a cavity provided in the upper frame member of the second gate section.

29. The safety gate recited in claim 28, further comprising a handle latching device disposed in the cavity and the handle for releasably retaining the handle and the actuator in the lowered position.

30. The safety gate recited in claim 25, wherein the first pair of compression springs has a first spring constant and the second pair of compression springs has a second spring constant, the first spring constant being greater than the second spring constant.

31. The safety gate recited in claim 25, wherein each of the first pair of compression springs independently urges the pair of movable bumpers toward the extended position.

32. The safety gate recited in claim 25, wherein each of the second pair of springs is preloaded when the moveable bumpers are in the retracted position.

33. The safety gate recited in claim 25, wherein the first pair of springs are loaded when the movable bumpers are driven toward the extended position.

* * * * *